US006648440B2

(12) United States Patent
Askeland et al.

(10) Patent No.: US 6,648,440 B2
(45) Date of Patent: Nov. 18, 2003

(54) SYSTEM AND METHOD FOR USING LOWER DATA RATES FOR PRINTHEADS WITH CLOSELY SPACED NOZZLES

(75) Inventors: Ronald A. Askeland, San Diego, CA (US); Mark S. Hickman, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/894,695

(22) Filed: Jun. 27, 2001

(65) Prior Publication Data

US 2003/0001915 A1 Jan. 2, 2003

(51) Int. Cl.[7] ..... B91J 29/38
(52) U.S. Cl. ..... 347/12; 397/9; 397/13
(58) Field of Search ..... 347/9, 11, 12, 347/14, 19, 15, 40, 41, 13

(56) References Cited

U.S. PATENT DOCUMENTS 5,610,638 A * 3/1997 Courtney ..... 347/14
5,742,305 A * 4/1998 Hackleman ..... 347/42
6,086,272 A * 7/2000 Kawase et al. ..... 400/61
6,334,665 B1 * 1/2002 Yoshida ..... 347/40

* cited by examiner

*Primary Examiner*—Stephen D. Meier
*Assistant Examiner*—Lam S Nguyen

(57) ABSTRACT

The present invention is embodied in a system and method for using lower data rates and less memory, for high nozzles per inch printheads. The printing system of the present invention includes a printhead assembly and an ink supply for printing ink on print media. The printhead assembly includes a printhead body, ink channels, a substrate, such as a semiconductor wafer, a nozzle member and a barrier layer located between the wafer and nozzle member. The nozzle member has plural nozzles coupled to respective ink channels and is secured at a predefined location to the printhead body with a suitable adhesive layer. The printhead has a controller which can be firmware, software or any suitable processor that can control the ejection of ink from the plural nozzles. The controller can be defined in the integrated circuit as receiving data stored in the data in the buffer memory, assigning primitive addresses in the heater array from the data, and determining the firing pulse rate of the heater elements in the heater array. The controller can be created by any suitable integrated circuit manufacturing or programming process.

5 Claims, 5 Drawing Sheets

SYSTEM AND METHOD FOR USING LOWER DATA RATES FOR PRINTHEADS WITH CLOSELY SPACED NOZZLES

FIELD OF THE INVENTION

The present invention generally relates to inkjet and other types of printers and more particularly, to a system and method for using lower data rates for high nozzles per inch [NPI] printheads.

BACKGROUND OF THE INVENTION

An inkjet printer produces a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkjet printers print dots by ejecting very small drops of ink onto the print medium and typically include a movable carriage that supports one or more print cartridges each having a printhead with a nozzle member having ink ejecting nozzles. The carriage traverses over the surface of the print medium. An ink supply, such as an ink reservoir, supplies ink to the nozzles. The nozzles are controlled to eject drops of ink at appropriate times pursuant to command of a microcomputer or other controller. The timing of the application of the ink drops is intended to correspond to the pattern of pixels of the image being printed.

In general, the small drops of ink are ejected from the nozzles through orifices by rapidly heating a small volume of ink located in vaporization chambers with small electric heaters, such as small thin film resistors. The small thin film resistors are usually located adjacent the vaporization chambers. Heating the ink causes the ink to vaporize and be ejected from the orifices. Specifically, for one dot of ink, an electrical current from an external power supply is passed through a selected thin film resistor of a selected vaporization chamber. The resistor is then heated for superheating a thin layer of ink located within the selected vaporization chamber, causing explosive vaporization, and, consequently, a droplet of ink is ejected from the nozzle and onto a print media. One very important factor in assuring high print quality is the placement of the ejected droplet upon the print media.

One problem that exists is assuring the accurate placement of ink droplets on the print media is the reduction or compensation for noise. Noise may be produced from mechanical or electrical or other sources and results in the random clustering of ink droplets on the print media forming bands. This may be offset by introducing intentional noise, dithering patterns, or asymmetric resolutions of the rectangular grid locations to be printed. Systems using large numbers of nozzles and/or multiple passes may offset banding through passive redundancy or active nozzle replacement. These systems would require higher data rates, increased buffer memory, and higher firing pulse rates.

Another problem in producing high print quality is controlling the number of passes and the number of nozzles required to produce the image. In a single pass a print-head may utilize 2400 nozzles per inch (npi) in printing 1200 dpi to the print media. Another print-head configuration may use 600 npi in a single pass with two 4 ng drops per nozzle, in printing 600 dpi to the print media. The former would require increased data to the print-head, increased printed data and therefore an increase in fire pulses to the heater elements of the print-head. Therefore, what is needed is a more efficient system of producing high quality printouts.

SUMMARY OF THE INVENTION

To overcome the limitations in the prior art described above, and to overcome other limitations that will become apparent upon reading and understanding the present specification, the present invention is embodied in a system and method for using lower data rates for high nozzles per inch printheads.

The printing system of the present invention includes a printhead assembly and an ink supply for printing ink on print media. The printhead assembly includes a printhead body, ink channels, a substrate, such as a semiconductor wafer, a nozzle member and a barrier layer located between the wafer and nozzle member. The nozzle member has plural nozzles coupled to respective ink channels and is secured at a predefined location to the printhead body with a suitable adhesive layer. The printhead has a controller which can be firmware, software or any suitable processor that can control the ejection of ink from the plural nozzles. The controller can be defined in the integrated circuit as receiving data stored in the data in the buffer memory, assigning primitive addresses in the heater array from the data, and determining the firing pulse rate of the heater elements in the heater array. The controller can be created by any suitable integrated circuit manufacturing or programming process.

The controller determines the firing order of the nozzles in a single or multiple swath. The location of a dot produced by a nozzle can also be changed in a column by changing the sequence in which the addresses of primitives are fired. A printhead may have up to 12 addresses per primitive. In an embodiment of the current invention every odd numbered nozzle is offset to the even numbered nozzles so that the horizontal data is encoded in a vertical axis. This feature maintains the resolution of the print swath in the horizontal axis and decreases the data rate required to produce the print by a factor of 2.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the invention.

FIG. 5A shows the invention with a lower nozzle printhead and FIGS. 5B–5D with high nozzles per inch (npi) printheads.

DETAILED DESCRIPTION OF THE PREFERRED EMBODIMENTS

In the following description of the invention, reference is made to the accompanying drawings, which form a part hereof, and in which is shown by way of illustration a specific example in which the invention may be practiced. It is to be understood that other embodiments may be utilized and structural changes may be made without departing from the scope of the present invention.

Figure 1:
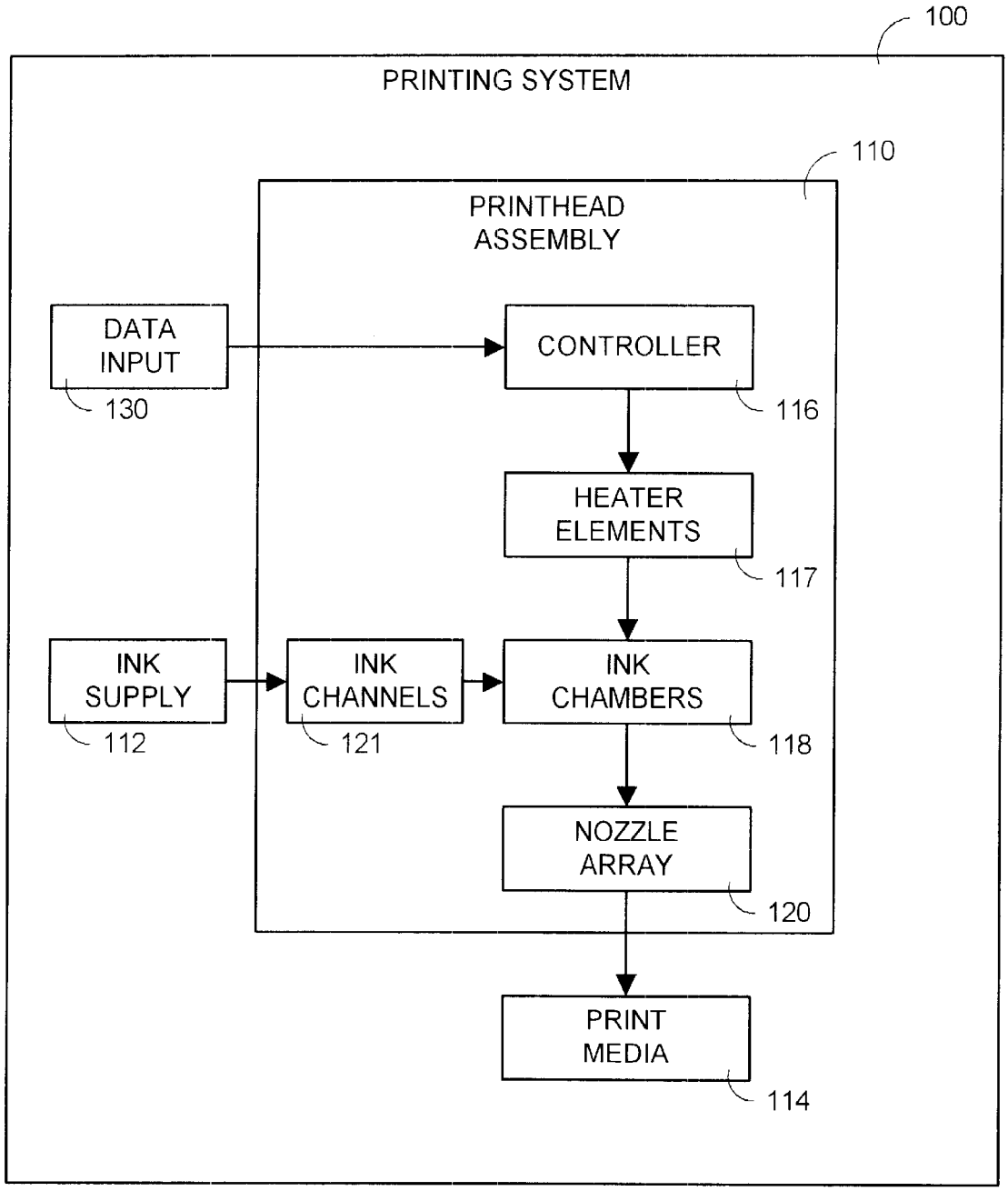
FIG. 1 shows a block diagram of an overall printing system incorporating the present invention.

I. General Overview:

FIG. 1 shows a block diagram of an overall printing system incorporating the present invention. The printing system 100 of the present invention includes a printhead assembly 110 that uses lower data rates for high nozzles per inch [NPI] printheads. The printhead assembly includes an ink supply 112 and print media 114. The printhead assembly 110 includes a controller 116, heater elements 117, ink chambers 118 with orifices or nozzles 120 fluidically coupled to associated ink channels 121.

During a printing operation of the high nozzles per inch [NPI] printheads, ink is provided from the ink supply 112 to an interior portion (such as an ink reservoir) of the printhead assembly 110. The interior portion of the printhead assembly 110 provides ink to the ink chambers 118 for allowing ejection of ink through adjacent nozzles 120. Namely, the printhead assembly 110 receives commands from a controller 116 to print ink and form a desired pattern for generating text and images on the print media 114. Print quality of the desired pattern is dependent on accurate placement of the ink droplets on the print media 114.

One way to maintain print quality is to improve the accuracy and precision of ink droplet placement. If this can be achieved by limiting the number of nozzles firing and by decreasing the rate of firing of each nozzle, data rates, memory, power and ink supply will all be decreased. To achieve this, in one embodiment of the present invention the controller 116 selects the elements in the heater array 117 to be fired. The controller 116 decreases the data rate to the heater element array 117, and this decreases the firing rate by the nozzle array 120. This decrease in data rate firing rate means that the printing system will require less power and less ink.

II. Exemplary Printing System

Figure 2:
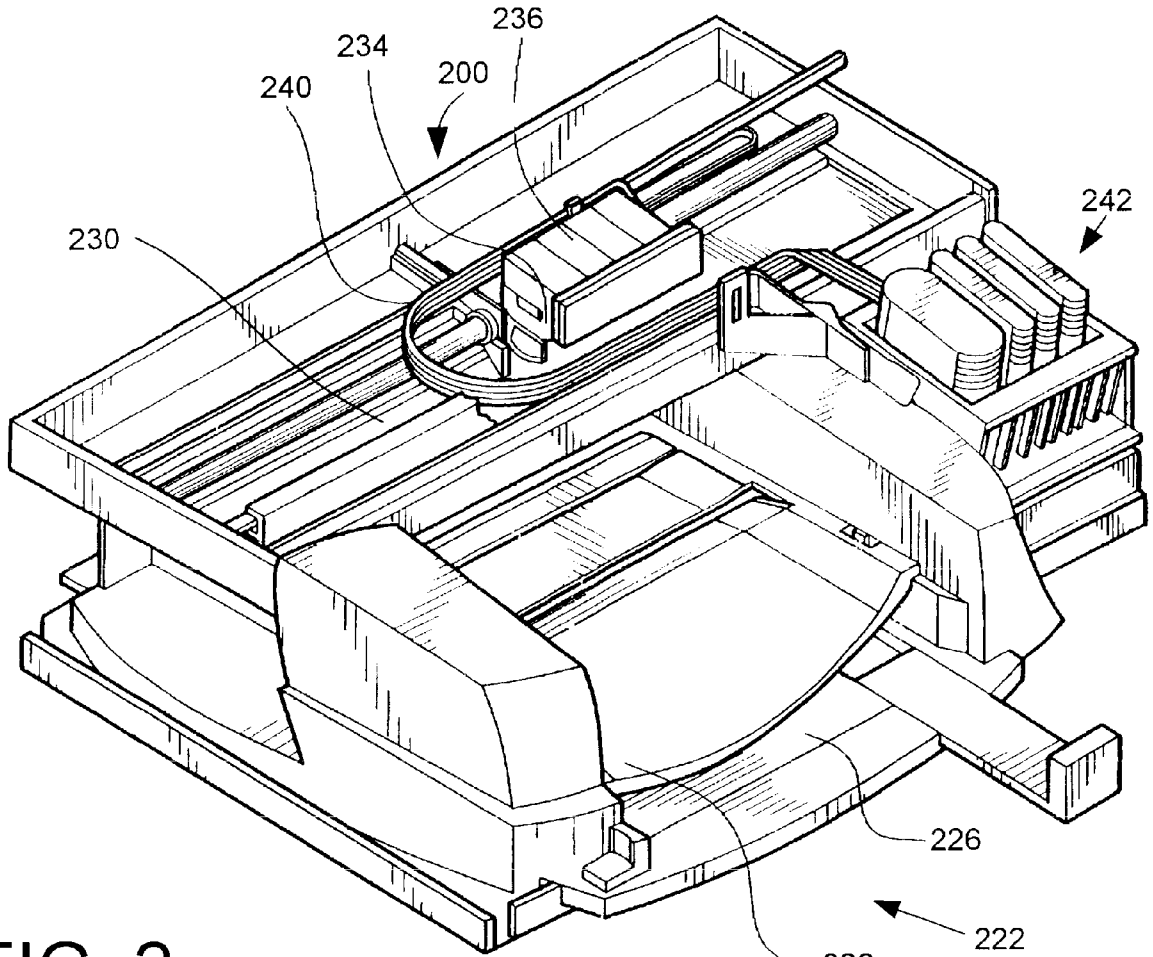
FIG. 2 is a high level flow diagram showing the address system of the present invention.

FIG. 2 is an exemplary high-speed printer that incorporates the invention and is shown for illustrative purposes only. Generally, printer 200 incorporates the lower data rates for high nozzles per inch [NPI] printheads and includes a tray 222 for holding print media 114 (shown in FIG. 1). When a printing operation is initiated, print media 114, such as a sheet of paper, is fed into printer 200 from tray 222 preferably using a sheet feeder 226. The sheet then brought around in a U direction and travels in an opposite direction toward output tray 228. Other paper paths, such as a straight paper path, can also be used.

The sheet is stopped in a print zone 230, and a scanning carriage 234, supporting one or more print cartridges 236, is then scanned across the sheet for printing a swath of ink thereon. After a single scan or multiple scans, the sheet is then incrementally shifted using, for example, a stepper motor and feed rollers to a next position within the print zone 230. Carriage 234 again scans across the sheet for printing a next swath of ink. The process repeats until the entire sheet has been printed, at which point it is ejected into output tray 228.

The present invention is equally applicable to alternative printing systems (not shown) such as those incorporating grit wheel or drum technology to support and move the print media 114 relative to the printhead assembly 110. With a grit wheel design, a grit wheel and pinch roller move the media back and forth along one axis while a carriage carrying one or more printheads scans past the media along an orthogonal axis. With a drum printer design, the media is mounted to a rotating drum that is rotated along one axis while a carriage carrying one or more printheads scans past the media along an orthogonal axis. In either the drum or grit wheel designs, the scanning is typically not done in a back and forth manner as is the case for the system depicted in FIG. 2.

The print cartridges 236 are of the type that use lower data rates for high nozzles per inch [NPI] printheads and may be removeably mounted or permanently mounted to the scanning carriage 234. Also, the print cartridges 236 can have self-contained ink reservoirs in the body of the printhead, as the ink supply 112 (shown in FIG. 1). The self-contained ink reservoirs can be refilled with ink for reusing the print cartridges 236. Alternatively, the print cartridges 236 can be each fluidically coupled, via a flexible conduit 240, to one of a plurality of fixed or removable ink containers 242 acting as the ink supply 112 (shown in FIG. 1). As a further alternative, ink supplies 112 can be one or more ink containers separate or separable from print cartridges 236 and removeably mountable to carriage 234. It should be noted that the present invention can be incorporated in any printhead and printer configuration.

III. Component and Operation Details

Figure 3:
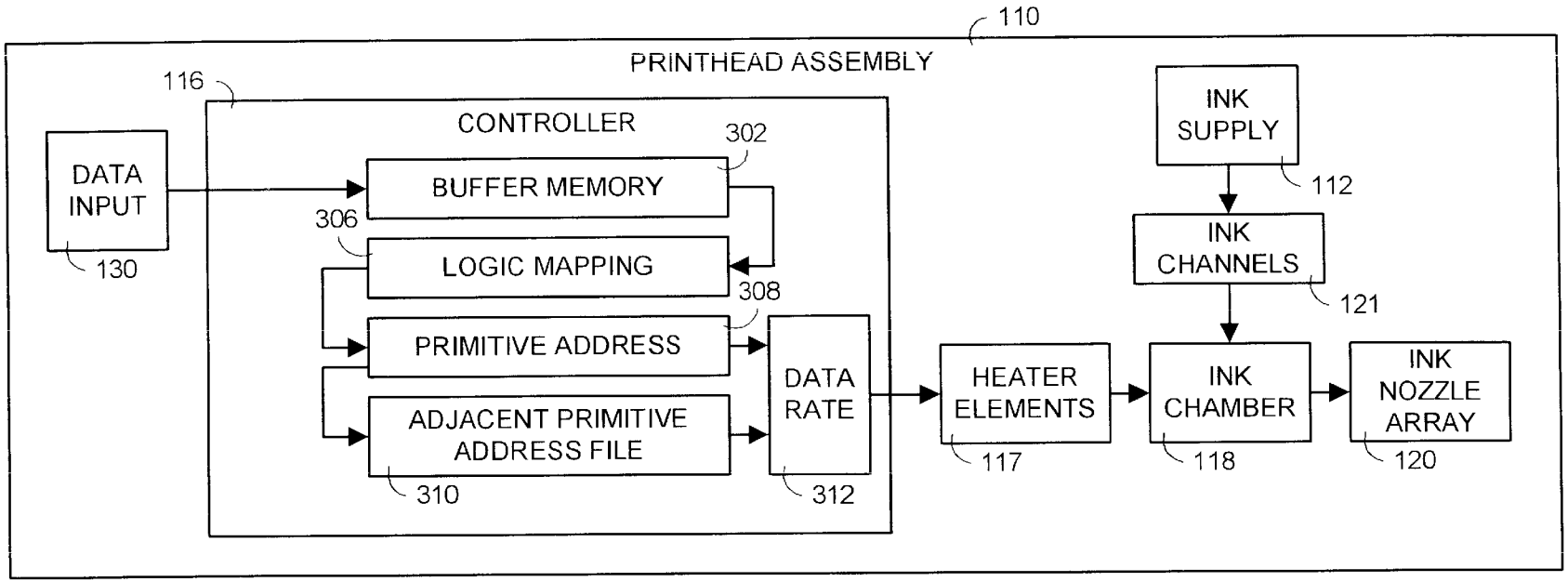
FIG. 3 is a high level flow diagram illustrating the address system of the present invention incorporated in single pass and multiple pass printing swaths.

Referring to FIGS. 1 and 2 along with FIG. 3, the printhead assembly 110 which uses lower data rates for high nozzles per inch [NPI] printheads is comprised of a controller 116 a heater element array 117 and a nozzle array 120. The controller 116 can be any integrated circuit, software, firmware etc. The heater element array can comprise numerous elements or resistors. Each resistor is allocated to a specific group of resistors, hereinafter referred to as a primitive. The printhead of the present invention can be arranged into any number of multiple subsections with each subsection having a particular number of primitives containing a particular number of resistors and primitive addresses.

The controller 116 contains the buffer memory 304, the logic mapping system 306, a primitive address file 308, adjacent primitive address file 310, and the data rate controller 312. When data enters the system from the data input 130 it is held in the buffer memory 304 of the controller 116 while the logic mapping system 306 analyzes the data. After the logic mapping system 306 has assigned pixel locations for the data these locations are registered at their respective primitive addresses 308.

An adjacent primitive address 310 is activated in the same time frame. The address files 308, 310 are assigned a rate of firing by the data rate system 312 and this information is then forwarded to the heater array element 117. The heater array element 117 heats the ink in the ink chambers 118 and expels ink droplets through the nozzles in the ink nozzle array 120. The ink nozzle array 120 preferably contains plural parallel rows of offset nozzles through the heater element array 117. It should be noted that other nozzle arrangements can be used, such as non-offset parallel rows of nozzles.

Figure 4:
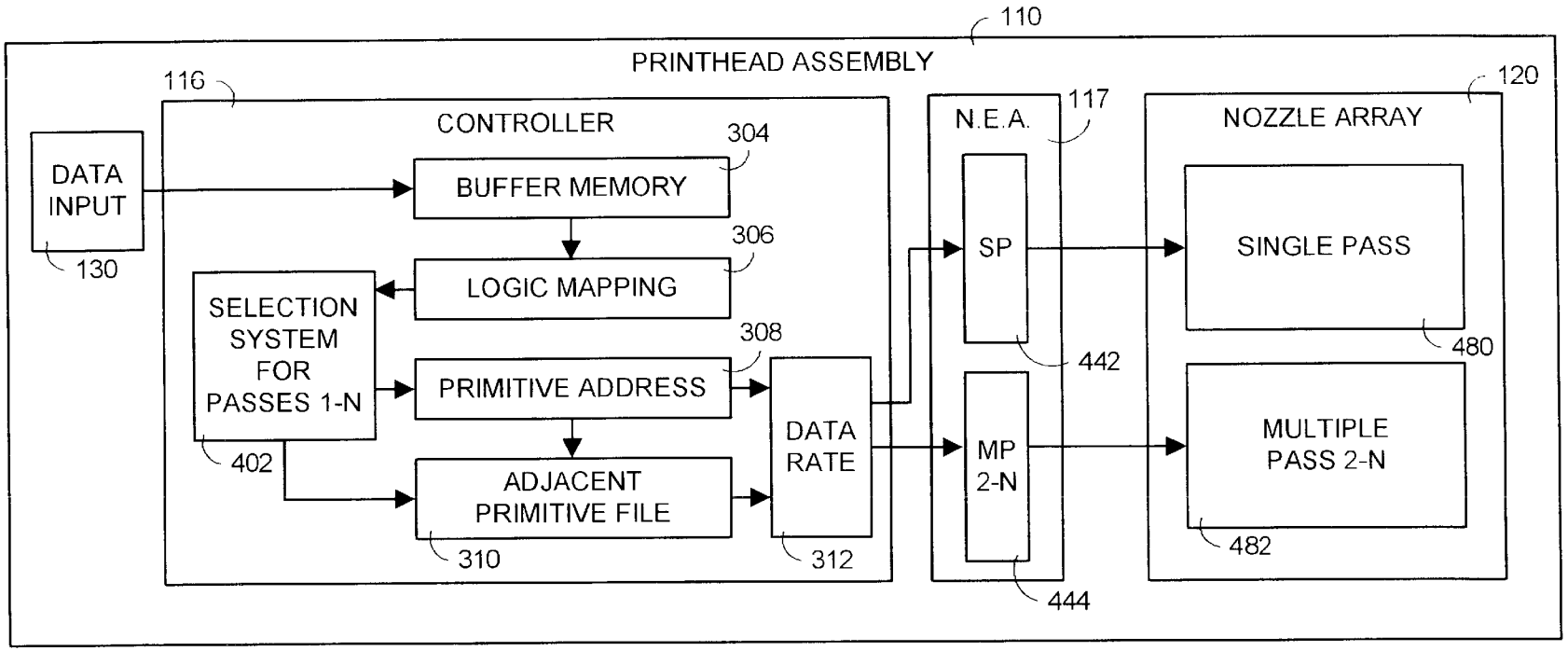
FIG. 4 is a high level flow diagram illustrating the present invention used in single pass and multiple pass modes.

FIG. 4 is a high level flow diagram illustrating the present invention used in single pass and multiple pass modes. Referring to FIGS. 1–3 along with FIG. 4 the printhead assembly 110 contains a controller 116, buffer memory 304, a logic mapping system 306, a primitive address file 308 and an adjacent address file 310. The logic mapping system 306 organizes the data. In this process a determination is made as to whether there will be a single pass or a multiple pass in the print swath. The selection of the pass number is forwarded to the selection system for passes 1–n, 402, before activating sites in the primitive address file 308 or the adjacent primitive address file 310.

One of the concerns using high nozzles per inch (npi) printheads in lower cost printers is that they increase data rates and swath buffer memory requirements. Going from a 600 npi printhead fired at 36 kHz to a 2400 printhead also fired at 36 kHz increases the data rate to the printhead by a factor of 4. A feature of the current invention is that it attains the benefits of a high npi printhead by operating the printhead with lower data rates.

Figures 5A, 5B, 5C, 5D:
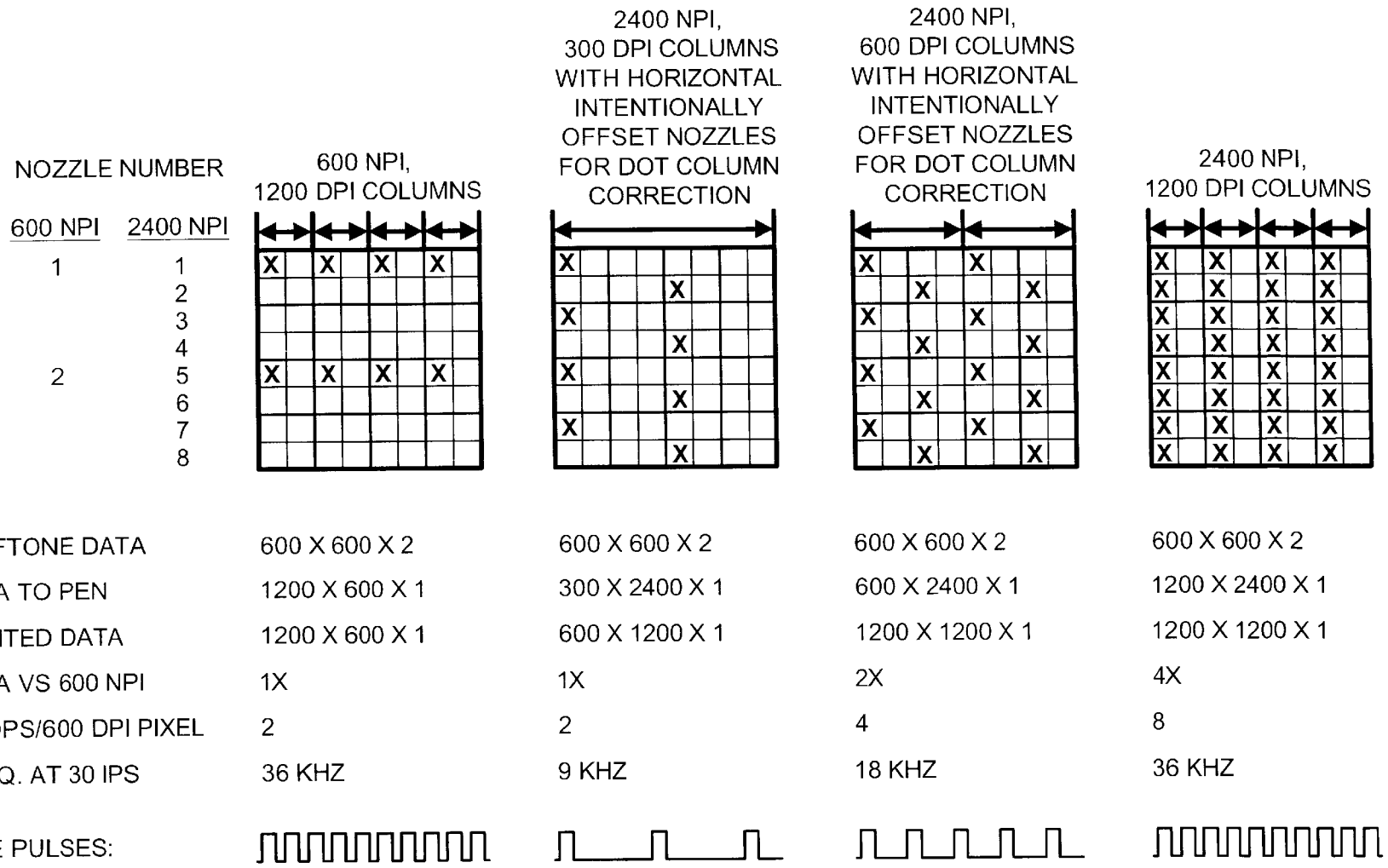
FIGS. 5A–D illustrate four scenarios. For example.

FIG. 5 illustrates four scenarios using high npi printheads. In FIG. 5A, a 600 npi printhead receives data for each 1200 dots per inch column. This requires a 36 kHz firing frequency at a 30 inch per second carriage speed. The ink density in a single pass is 2 drops per 600 dots per inch pixel. FIG. 5D illustrates a 2400 npi printhead operating with the highest data rate. Data is sent down for each 1200 dots per inch column requiring a 36 kHz firing frequency at a 30 inch per second carriage speed. The ink density in a single pass is 8 drops per 600 dots per inch pixel. It makes mathematical sense that 4 times the nozzles used would require 4 times the number of ink drops.

By comparison FIG. 5B illustrates a 2400 npi printhead printing to a 300 dots per inch column. This operation requires a 9 kHz firing frequency at a 30 inch per second carriage speed with an ink density of 2 drops per 600 drops per inch pixel. As in the 2 previous examples the halftone data is the same but the printhead is operating at one quarter of the data rate. This is an embodiment of the present invention in that the printhead have decreased data rate and buffer memory requirements.

FIG. 4 shows that data from the logic mapping system 306 is not only controlled for rate through the data rate system 312, but is also analyzed for the number of passes to be made by the printhead. A single pass will require that data and data rate information from the data rate system 312 will activate single pass heater elements 402 in the heater element array 117. In FIG. 5A, in a single pass, when 1 nozzle does not fire, no drops are printed for that 600 dots per inch row.

By comparison, in FIG. 5D, in a single pass, when 1 nozzle does not fire ¾ of the drops are printed for that 600 dots per inch row. This passive redundancy takes place because each 600 dots per inch data row is printed by 4 nozzles. Similarly FIG. 5B is printed by 4 nozzles and will have the same level of passive redundancy. This embodiment of the present invention maintains the level of passive redundancy as well operating at a lower data rate and firing frequency.

FIG. 4 also shows that data from the logic mapping system 306 can activate the multipass 2–n heater array 404 in the heater element array 117. The multipass 2–n heater array 404, will result in ink drops being ejected from the multipass 2–n nozzle array 482 in the nozzle array 120. Multipass printmodes improve passive redundancy. In a 4 pass mode, a 600 npi printhead with a nozzle not firing, prints ¾ of the ink droplets for that data row. A 2400 npi printhead, printed in a 4 pass mode with 1 nozzle not firing would print 15/16 of the ink droplets for that data row. This is without nozzle replacement. Active nozzle replacement can be done between passes in a multipass printmode.

Active nozzle replacement requires that a missing nozzle is replaced by its nearest neighbor. Referral to FIGS. 3–4 shows that within the controller 116, the logic mapping system 306 activates the primitive address file 308 and the adjacent primitive address file 310. These files in turn activate the heater element array 117 which results in the ejection of ink droplets from the ink nozzle array 120. Using active nozzle replacement, a missing nozzle can be replaced by its nearest neighbor, activated through the adjacent address file 310, so that all the drops are printed for each data row in a single pass in this embodiment of the present invention.

A further feature of the present invention are the cases presented in FIGS. 5B and 5C. The nozzles in these embodiments of the invention are intentionally offset. The nozzles are aligned horizontally to the nearest 1/2400 inch using ¼ dot column correction. The even numbered nozzles of the ink nozzle array 120, are intentionally offset by 1/1200 inch [½ a dot column]. The printhead is operated ½ the data rate of the 1200 dots per inch column. The total number of drops per 600 dots per inch pixel in a single pass is reduced from 8 to 4, and the firing frequency at 30 inches per second is reduced from 36 kHz to 18 kHz. This embodiment of the invention allows the system to operate at a lower data rate and concomitantly to use less memory.

Therefore, in conclusion, the controller 116 includes the logic mapping system 316 that sets the data rates and firing rates to the heater element array 117. The current invention results in a decrease in data rates which has two immediate effects, a decrease in buffer memory 304, and a decrease in the power required to operate the printing system 100. These efficiencies are translated as well in the heater element array 117 where fewer elements will be required to fire. In turn fewer nozzles of the ink nozzle array 120 will be employed in the printing process and less ink will be used. The current invention is able to achieve these efficiencies without a decrease in printing quality.

Print quality is achieved by three measures. In the first, the activation of the adjacent primitive address file 310 in an embodiment of the current invention, results in active nozzle replacement ensuring that all ink droplets are printed for each data row in a single pass. In the second, the utilization of a high nozzle per inch printhead as illustrated in FIG. 5B allows for a high level of passive redundancy as each row is printed by 4 nozzles.

The third measure employs the primitive address file 308. In this embodiment of the present invention all nozzles are aligned horizontally using a ¼ dot column correction, and each even nozzle is intentionally offset using a ½ dot column. In this scenario the data rate may be decreased, the ink drops per pixel in a single pass are reduced as is the maximum firing frequency. This would allow "pseudo nozzle replacement" in black depletion masks.

IV. Conclusion

The above measures are illustrations primarily focused on fully saturated single pass printing. This printmode is the most demanding and it is therefore understood that the technique of the current invention would work especially well for draft mode printing.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method for using low data rates for a high nozzle per inch printhead having a heater array with heater elements, comprising:

receiving data related to the printhead stored in memory;

assigning primary primitive addresses for the heater array based on the data;

analyzing the data and the primitive address assignments to determine a firing pulse rate of the heater elements in the heater array;

intentionally offsetting a predefined number of the nozzles; and limiting the number of nozzles that fire at a given time while simultaneously decreasing the firing pulse rate of each nozzle to maintain accuracy and precision of ink droplet placement.

2. The method of claim 1, further comprising assigning pixel locations of the ink drops based on the data and then registering the pixel locations at respective primitive firing addresses.

3. The method of claim 1, further comprising activating secondary adjacent primitive addresses during a same time frame as the primary primitive addresses.

4. The method of claim 1, further comprising horizontally aligning the nozzles of the nozzle member with dot column correction.

5. The method of claim 1, further comprising offsetting a predefined number of nozzles to allow reduction of he data rate, amount of ink drops and firing frequency in a single print swath.

* * * * *

UNITED STATES PATENT AND TRADEMARK OFFICE

CERTIFICATE OF CORRECTION

PATENT NO. : 6,648,440 B2
DATED : November 18, 2003
INVENTOR(S) : Askeland et al.

It is certified that error appears in the above-identified patent and that said Letters Patent is hereby corrected as shown below:

Column 8,
Line 9, delete "he" and insert thereof -- the --.

Signed and Sealed this

Twelfth Day of October, 2004

JON W. DUDAS
*Director of the United States Patent and Trademark Office*